US006716116B1

(12) United States Patent
Yokota

(10) Patent No.: US 6,716,116 B1
(45) Date of Patent: Apr. 6, 2004

(54) ONE-PIECE GOLF BALL

(75) Inventor: Masatoshi Yokota, Akashi (JP)

(73) Assignee: Sumitomo Rubber Industries Limited, Kobe (JP)

( * ) Notice: Subject to any disclaimer, the term of this patent is extended or adjusted under 35 U.S.C. 154(b) by 59 days.

(21) Appl. No.: 09/613,827

(22) Filed: Jul. 11, 2000

(30) Foreign Application Priority Data

Jul. 12, 1999 (JP) ..... 11-197836

(51) Int. Cl.[7] ..... A63B 37/12
(52) U.S. Cl. ..... 473/378
(58) Field of Search ..... 473/351, 353, 473/367, 368, 371, 377, 378

(56) References Cited

U.S. PATENT DOCUMENTS 5,007,647 A * 4/1991 Gulick ..... 473/353
5,156,405 A * 10/1992 Kitaoh et al. ..... 473/378
5,228,697 A * 7/1993 Gulick et al. ..... 473/353
5,731,371 A * 3/1998 Nesbitt et al. ..... 473/372
5,985,370 A * 11/1999 Ohira et al. ..... 473/387
5,998,506 A * 12/1999 Nesbitt ..... 473/372
6,022,279 A * 2/2000 Yamagishi et al. ..... 473/353

FOREIGN PATENT DOCUMENTS

JP 07051403 A 2/1995
JP 07051403 A * 2/1995 ..... A63B/37/00

* cited by examiner

*Primary Examiner*—Raeann Gordon
(74) *Attorney, Agent, or Firm*—Birch, Stewart, Kolasch & Birch, LLP

(57) ABSTRACT

A one-piece golf ball comprises a ball body and a clear coat onto the surface of the ball body. The ball body is formed from a white rubber composition containing 0.5 to 5 parts by weight of a titanium oxide, and 0.001 to 0.1 part by weight of a blue pigment relative to 100 parts by weight of the matrix rubber. The clear coat includes 0.02 to 0.5 part by weight of a fluorescent whitening agent, 0.05 to 3 parts by weight of an ultraviolet absorbent, and 100 parts by weight of a resinous component. The one-piece golf ball has a brightly white appearance and a satisfactory adhesion of the clear coat.

21 Claims, 1 Drawing Sheet

ONE-PIECE GOLF BALL

BACKGROUND OF THE INVENTION

1. Field of the Invention

This invention relates to a one-piece golf ball comprising a ball body made from a white rubber composition, and a clear coat formed on the ball body without the application of a white paint.

2. Description of the Related Art

To yield brightly white surfaces of balls, conventional one-piece golf balls are covered with a white paint and are then covered with a clear coat. However, on a demand to provide a simplified coating process, attempts have been made to provide a one-piece golf ball comprising a ball body made from a white rubber composition and a clear coat formed on the surface of the ball body without coating of a white paint.

If the coat of a white paint is omitted, the ball body must be brightly white to ensure the appearance of the ball as white as conventional equivalents. However, such ball body made from a rubber composition cannot be significantly brightly white. In addition, the ball body made from a rubber is covered directly with a clear coat, the constitutive rubber is greatly deteriorated due to ultraviolet irradiation or ozone-induced oxidation. The deterioration of rubber due to ultraviolet irradiation or ozone-induced oxidation invites discoloring of the rubber ball body, and delamination of the clear coat due to deteriorated adhesion between the rubber ball body and clear coat.

SUMMARY OF THE INVENTION

Accordingly, it is an object of the invention to provide a one-piece golf ball comprising a ball body made from a white rubber composition, and a clear coat, the golf ball having a brightly white appearance and a satisfactory adhesion of the clear coat.

Specifically, the invention provides a one-piece golf ball comprising a ball body and a clear coat, wherein the ball body is made from a rubber composition including a matrix rubber, an α, β-unsaturated carboxylic acid and/or its metal salt, and an organic peroxide, and the clear coat being applied onto the surface of the ball body. In the golf ball, the rubber composition is a white rubber composition containing 0.5 to 5 parts by weight of a titanium oxide, and 0.001 to 0.1 part by weight of a blue pigment relative to 100 parts by weight of the matrix rubber, and the clear coat contains 0.02 to 0.5 part by weight of a fluorescent whitening agent, 0.05 to 3 parts by weight of an ultraviolet absorbent, and 100 parts by weight of a resinous component.

DESCRIPTION OF THE PREFERRED EMBODIMENT

Figure 1:
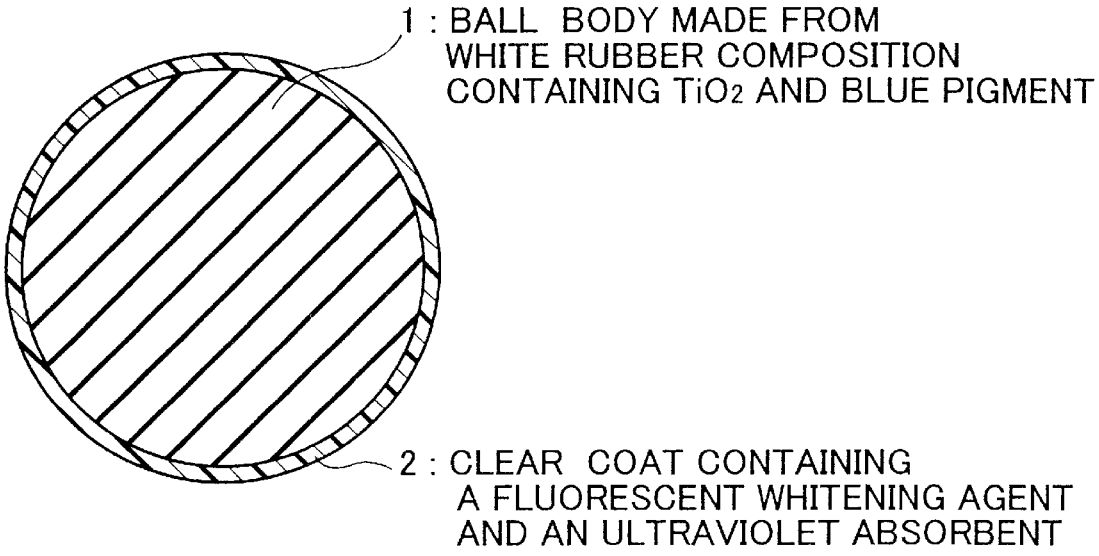
FIG. 1 is a schematic diagram showing the structure of one-piece golf ball of the invention.

The invented one-piece golf ball comprises a ball body 1 and a clear coat 2 formed on the ball body 1 as shown in FIG. 1. The ball body 1 is made from a white rubber composition.

The white rubber composition is obtained by incorporating a titanium oxide and a blue pigment into conventionally employed components, i.e., a matrix rubber, an α, β-unsaturated carboxylic acid and/or metal salt thereof, and an organic peroxide.

Such matrix rubbers include, but are not limited to, butadiene rubber (BR), ethylene-propylene-diene terpolymer (EPDM), isoprene rubber (IR), isobutylene-isoprene rubber (IIR), natural rubber (NR), nitrile rubber (NBR), and styrene rubber (SBR). Each of these rubbers can be employed alone or in combination. Of these rubbers, those essentially composed of butadiene are preferred. More typically, the matrix rubber should preferably comprise 50% by weight or more of a butadiene rubber. As the butadiene rubber, a polybutadiene having a high content of cis-bonds, i.e., containing 90% or more of cis-1,4-bonds, is typically preferred.

The α, β-unsaturated carboxylic acids and metal salts thereof include, but are not limited to, acrylic acid, methacrylic acid, and other α, β-unsaturated carboxylic acids each having 3 to 8 carbon atoms, and zinc salts, magnesium salts, and other monovalent or divalent metal salts of these carboxylic acids. Among them, zinc acrylate is advantageously used to provide a high resilience. The amount of the unsaturated carboxylic acid and/or a metal salt thereof is preferably 15 to 40 parts by weight and more preferably 18 to 38 parts by weight, relative to 100 parts by weight of the matrix rubber. If the amount of the unsaturated carboxylic acid and/or a metal salt thereof is less than 15 parts by weight, the resulting ball body becomes excessively soft and largely deforms when a shot is made, and adhesion of the clear coat may be deteriorated. In contrast, a amount of the unsaturated carboxylic acid exceeding 40 parts by weight invites an excessively hard shot feeling.

Illustrative organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Dicumyl peroxide is typically preferred. The amount of the organic peroxide is preferably 0.3 to 5.0 parts by weight, and more preferably 0.5 to 3.0 parts by weight, relative to 100 parts by weight of the matrix rubber.

The titanium oxide is incorporated as a white pigment into the rubber composition. The type of the titanium oxide is not critical but rutile titanium oxide is advantageously employed for its high masking (shielding) property. The amount of the titanium oxide should be 0.5 to 5 parts by weight, and preferably 0.5 to 2 parts by weight, relative to 100 parts by weight of the matrix rubber. The clear coat in the invented golf ball comprises a fluorescent whitening agent and an ultraviolet absorbent, and the rubber composition for the ball body has only to contain the titanium oxide in a necessary and sufficient amount. However, to ensure a sufficient masking property and to provide a brightly white appearance, the rubber composition should contain 0.5 part by weight or more of the titanium oxide relative to 100 parts by weight of the matrix rubber.

The blue pigment is incorporated into the rubber composition to emphasize the white color. Such blue pigments include, but are not limited to, ultramarine blue pigment, cobalt blue pigment, and copper phthalocyanine blue pigment. The amount of the blue pigment is 0.001 to 0.1 part by weight, relative to 100 parts by weight of the matrix rubber. If the amount of the blue pigment is less than 0.001 part by weight, the resulting golf ball is insufficiently blue-colored and has a yellowish color. In contrast, if the amount of the blue pigment exceeds 0.1 part by weight, the resulting golf ball is excessively blue-colored and cannot significantly have a brightly white appearance.

The white rubber composition for the ball body may further comprise various additives according to necessity. Such additives include, but are not limited to, anthraquinone violet pigment, dioxazine violet pigment, methyl violet pigment, and other violet pigments; zinc oxide, silica, calcium carbonate, barium sulfate, and other fillers.

The clear coating to form the clear coat 2 will now be described in detail.

The clear coating comprises a urethane resin, an acrylic resin, or another coat-forming component, and a fluorescent whitening agent and an ultraviolet absorbent.

Such fluorescent whitening agents include, but are not limited to, Ubitex O.B [trade name, available from Ciba Geigy Ltd., a butyl-benzoxazole derivative chemically known as 2,5-bis(5-tert-butyl-2-benzoxazolyl)thiophene], White Flour PCS (trade name, available from Sumitomo Chemical Co., Ltd.), and Hoslaluv KCB (trade name, available from Hoechst Japan Ltd.). With respect to fluorescent whitening agents, a butyl-benzoxazole and/or derivative thereof.

Incorporation of the fluorescent whitening agent into the clear coat makes the appearance of the golf ball brightly white. In the case of incorporating the fluorescent whitening agent into the ball body, large amounts of fluorescent whitening agent must be incorporated into the rubber composition for the ball body, which invites high costs of the ball due to an expensive fluorescent whitening agents.

The amount of the fluorescent whitening agent is 0.02 to 0.5 part by weight and preferably 0.05 to 0.3 part by weight, relative to 100 parts by weight of the coat-forming component (resinous component) of the clear coating. If the amount of the fluorescent whitening agent is less than 0.02 part by weight, sufficient whitening activity cannot be obtained, and in contrast, if the amount exceeds 0.5 part by weight, the whitening activity becomes saturated and the adhesion of the clear coat may be deteriorated.

The ultraviolet absorbent is incorporated into the clear coat to inhibit the deterioration of the clear coat itself and to reduce ultraviolet radiation that reaches the ball body to thereby inhibit the deterioration of the rubber constituting the ball body. In this connection, ultraviolet-induced deterioration of the ball body itself will be inhibited by incorporating the ultraviolet absorbent or large amounts of the titanium oxide into the ball body. However, even in this case, the ultraviolet-induced deterioration of the clear coat itself cannot be inhibited. The ultraviolet absorbent is therefore meaningfully incorporated into the clear coat. Such ultraviolet absorbents include, but are not limited to, salicylic acid derivatives, benzophenones, benzotriazoles, substituted acrylonitriles, and nickel complexes. Such ultraviolet absorbents are available as, for example, Tinuvin 900 (trade name, a product of Ciba Geigy Ltd.) and Uvinul N-35 (trade name, a product of BASF AG).

The amount of the ultraviolet absorbent is preferably 0.05 to 3 parts by weight and more preferably 0.5 to 2.5 parts by weight, relative to 100 parts by weight of the resinous component. If the amount of the ultraviolet absorbent is less than 0.05 part by weight, the deterioration of the resulting ball cannot be sufficiently inhibited. In contrast, if the amount exceeds 3 parts by weight, the inhibitory activity of deterioration becomes saturated and the adhesion of the clear coat to the ball body is decreased.

Separately, a proposal has been made to achieve a brightly white appearance of a ball by incorporating an antioxidant and a photostabilizer into a clear coating (e.g., Japanese Unexamined Patent Application Publication No. 7-51403). The antioxidant and photostabilizer are intended to inhibit oxygen-induced or light-induced deterioration of resins and rubbers but cannot effectively ensure a white appearance on a long-term exposure to ultraviolet radiation (resistance to weather-induced discoloring). In contrast, the use of an ultraviolet absorbent and a fluorescent whitening agent in the clear coating can inhibit discoloring and ensure a brightly white appearance stable for a long time, without the incorporation of an antioxidant and a photostabilizer. However, the invention does not exclude the use of such antioxidants and photostabilizers.

The invented one-piece golf ball comprises a core formed by subjecting the above-mentioned rubber composition to hot-press-molding, and a clear coat formed by applying the clear coating onto the surface of the ball body. If a mark or the like is to be printed on the ball body, the mark may be printed on the ball body prior to the application of the clear coating.

Prior to the application of the clear coating, the ball body may be subjected to a pretreatment to improve the adhesion of the clear coat. Such pretreatments include, for example, surface polishing, sand blasting, flame treatment, plasma treatment, and corona discharge treatment. To improve the adhesion of the clear coat, a pretreatment with a silane coupling agent is typically preferred.

The pretreatment with a silane coupling agent employed herein mainly includes the steps of diluting a silane coupling agent with a solvent to give a solution, and immersing the ball body to be treated in the solution. Such silane coupling agents include, but are not limited to, γ-chloropropyltrimethoxysilane, vinyltris(β-methoxyethoxy)silane, N-β-(aminoethyl)-γ-aminopropyltrimethoxysilane, γ-glycidyloxypropyltrimethoxysilane, and other organic silicon compounds each having one Si atom in the molecule, and organic silicon compounds each having two or more Si atoms in the molecule. The pretreatment with a silane coupling agent can be performed more easily than the sand blasting and flame treatment, and does not adversely affect an aesthetic surface of the ball body, and is therefore a typically advantageous pretreatment in combination with the clear coat. In addition, the solution of the silane coupling agent is quickly dried, and the pretreated ball body can be subjected to the subsequent coating process of the clear coating without delay. Thus, the coating process is still simple.

The invented one-piece golf ball preferably deforms 2.0 to 4.0 mm and more preferably deforms 2.2 to 3.5 mm by compression when an initial load of 10 kgf is increased to an ultimate load of 130 kgf. When the golf ball deforms to a degree within the above range, the clear coat can be sufficiently adhered to the ball body with a good shot feeling.

As thus described, the invented one-piece golf ball has a clear coat formed on the surface of a white ball body, and exhibits a brightly white appearance that is stable for a long time, and the clear coat has a satisfactory adhesion. The invention can therefore provide one-piece golf balls which are satisfactory in appearance, resistance to discoloring, and adhesion of the coat without the application of a white paint.

The present invention will now be illustrated in more detail with reference to several invented examples and comparative examples below, which are not intended to limit the scope of the invention.

EXAMPLE

[Evaluation Method]

The characteristic properties of golf balls were evaluated as follows.

(1) Appearance

Ten amateur golf players evaluated a ball by visual observation as compared with a commercially available one-piece golf ball (standard range, available from Sumitomo Rubber Industries Ltd., Japan) according to the following criteria:

○: eight or more players felt quite normal

X: three or more players felt strange (2) Weathering Test

A ball to be tested was subjected to a weathering test of irradiation for 120 hours using a Sunshine Super Long Life Weathermeter (Type WEL-SUN-HC.B, available from Suga Test Instruments, Japan) at a chamber temperature of 63° C., at a humidity of 50%, and with rainfall for 12 minutes per 60 minutes. The discoloring and the adhesion of the ball after irradiation were evaluated according to the following criteria.

(a) Discoloring

Evaluation was made in three ranks, "○", "Δ", and "X" according to the degree of discoloring after irradiation as compared with the color before irradiation.

(b) Adhesion

A sample ball after the ultraviolet irradiation was hit 50 times at a speed of 45 m/s toward an iron plate with the same grooves as in a club face. The appearance of the clear coat after hitting was observed, and the adhesion was evaluated as "○" when no peeling was observed, and as "X" when peeling was observed.

(3) Deformation (mm)

The compressive deformation (mm) of a sample ball was determined when an initial load of 10 kgf was increased to a final load of 130 kgf.

(4) Shot Feeling

Ten amateur golf players hit a sample ball with a metal driver #1. The shot feeling was evaluated as "○" when the player felt a small impact, and as "X" when the player felt a large impact, and the majority of the evaluation was defined as the shot feeling of the ball in question.

[Preparation of Golf Balls]

(1) Preparation of Ball Body

A series of one-piece golf ball bodies "a" to "i" were prepared by preparing rubber compositions "a" to "i" having the compositions indicated in Table 1, charging each of the rubber compositions into a mold, and hot-press-molding the rubber composition at 65° C. for 25 minutes. The ball bodies "a", "c"to "e", "h", and "i" were met the requirements according to the invention.

As a butadiene rubber, a polybutadiene rubber with a high cis-bond content (trade name: BR-11, available from JSR, Japan) was employed.

TABLE 1

| Ball body | a | b | c | d | e | f | g | h | i |
|---|---|---|---|---|---|---|---|---|---|
| Butadiene rubber | 100 | 100 | 100 | 100 | 100 | 100 | 100 | 100 | 100 |
| Methacrylic acid | 12 | 25 | 25 | 25 | 25 | 25 | 25 | 35 | 45 |
| Zinc oxide | 23 | 23 | 23 | 23 | 23 | 23 | 23 | 23 | 23 |
| Calcium carbonate | 2.0 | 2.0 | 2.0 | 2.0 | 2.0 | 2.0 | 2.0 | 2.0 | 2.0 |
| Titanium oxide | 1.0 | 0.3 | 0.7 | 1.0 | 1.8 | 1.0 | 1.0 | 1.0 | 1.0 |
| Dicumyl peroxide | 1.0 | 1.0 | 1.0 | 1.0 | 1.0 | 1.0 | 1.0 | 1.0 | 1.0 |
| Blue pigment | 0.01 | 0.01 | 0.01 | 0.01 | 0.01 | 0 | 0.2 | 0.01 | 0.01 |

(2) Preparation of Clear Coating

A series of clear coatings "A" to "J" were prepared by incorporating varying amounts of an ultraviolet absorbent (Tinuvin 900), a fluorescent whitening agent (Ubitex OB), an antioxidant (IRGANOX 1098 available from Nippon Ciba Geigy Ltd., Japan), and a photostabilizer (SANOL SL770 available from Sankyo Co., Ltd., Japan) into 100 parts by weight of an urethane resin as a coat-forming resin. The clear coatings "B" to "D" were clear coatings meeting the requirements according to the invention.

These clear coatings were two-pack urethanes each comprising a polyurethane polyol and a polyisocyanate, and the ultraviolet absorbent and the fluorescent whitening agent were added to the polyurethane polyol.

TABLE 2

| Clear coating | A | B | C | D | E | F | G | H | I | J |
|---|---|---|---|---|---|---|---|---|---|---|
| Urethane resin | 100 | 100 | 100 | 100 | 100 | 100 | 100 | 100 | 100 | 100 |
| Fluorescent whitening agent | 0 | 0.05 | 0.2 | 0.2 | 0.2 | 0 | 0 | 0 | 0.2 | 0 |
| Ultraviolet absorbent | 0 | 0.5 | 1.0 | 2.5 | 0 | 0.5 | 0 | 0 | 0 | 0.5 |
| Antioxidant | 0 | 0 | 0 | 0 | 0 | 0 | 1.0 | 1.0 | 1.0 | 1.0 |
| Photo-stabilzer | 0 | 0 | 0 | 0 | 0 | 0 | 0 | 1.0 | 1.0 | 1.0 |

(3) Preparation of Golf Ball

Each of the above-prepared ball body was immersed in a 1% by weight solution of a silane coupling agent KBP-43 (trade name, available from Shin-Etsu Chemical Co., Ltd., Japan) in isopropyl alcohol, and was dried. Each of the above-prepared clear coatings was applied onto the dried ball body to yield golf balls (Examples 1 to 10 and Comparative Examples 1 to 12). The appearances, weathering resistances and shot feelings of the prepared golf balls were evaluated according to the evaluations methods described above. The types of the ball bodies and clear coatings, and the results of evaluation are shown in Table 3 (examples) and Table 4 (comparative examples).

TABLE 3

| Example No. | 1 | 2 | 3 | 4 | 5 | 6 | 7 | 8 | 9 | 10 |
|---|---|---|---|---|---|---|---|---|---|---|
| Ball body | c | c | c | d | d | d | e | e | e | h |
| Clear coating | B | C | D | B | C | D | B | C | D | C |
| Deformation | 2.6 | 2.6 | 2.6 | 2.6 | 2.6 | 2.6 | 2.6 | 2.6 | 2.6 | 2.3 |
| Appearance | ○ | ○ | ○ | ○ | ○ | ○ | ○ | ○ | ○ | ○ |
| Discoloring | ○ | ○ | ○ | ○ | ○ | ○ | ○ | ○ | ○ | ○ |
| Adhesion | ○ | ○ | ○ | ○ | ○ | ○ | ○ | ○ | ○ | ○ |
| Shot feeling | ○ | ○ | ○ | ○ | ○ | ○ | ○ | ○ | ○ | ○ |

TABLE 4

| Comp.Ex. No. | 1 | 2 | 3 | 4 | 5 | 6 | 7 | 8 | 9 | 10 | 11 | 12 |
|---|---|---|---|---|---|---|---|---|---|---|---|---|
| Ball body | a | b | f | g | i | d | d | d | d | d | d | d |
| Clear coating | C | C | C | C | C | A | E | F | G | H | I | J |
| Deformation | 4.8 | 2.6 | 2.6 | 2.6 | 1.8 | 2.6 | 2.6 | 2.6 | 2.6 | 2.6 | 2.6 | 2.6 |
| Appearance | ○ | X | X | X | ○ | X | ○ | X | X | X | ○ | X |
| Discoloring | ○ | Δ | Δ | ○ | ○ | X | X | ○ | Δ | Δ | Δ | ○ |
| Adhesion | X | ○ | ○ | ○ | ○ | ○ | ○ | ○ | ○ | ○ | ○ | ○ |
| Shot feeling | ○ | ○ | ○ | ○ | X | ○ | ○ | ○ | ○ | ○ | ○ | ○ |

The ball according to Comparative Example 2 contained an excessively small amount of titanium oxide in the ball body and was poor in masking property. The ball was therefore had an insufficient appearance even coated with a clear coat containing a fluorescent whitening agent and was liable to discolor after ultraviolet irradiation.

When the ball body contained no blue pigment, the resulting ball had a yellowish color and could not have a satisfactorily white appearance (Comparative Example 3), and in contrast, when the ball body contained an excessively large amount of a blue pigment, the resulting ball had a bluish color and could not have a satisfactorily white appearance (Comparative Example 4).

Comparison between Comparative Examples 6 and 7 was shown that when the clear coat contained no fluorescent whitening agent, the resulting ball could not exhibit a brightly white appearance. Comparison between Comparative Examples6 and 8 was shown that when the clear coat contained no ultraviolet absorbent, the resulting ball could not be significantly resistant to discoloring after ultraviolet irradiation. The results of Comparative Examples 9 and 10 were shown that when the clear coat contained a photostabilizer and an antioxidant but contained neither fluorescent whitening agent nor ultraviolet absorbent, the resulting ball could neither exhibit satisfactory appearance nor be sufficiently resistant to discoloring. The results of Comparative Examples 11 and 12 were shown that when the clear coat contained a photostabilizer and an antioxidant and either fluorescent whitening agent or ultraviolet absorbent, the resulting ball could not exhibit both satisfactory appearance and resistant to discoloring.

A ball that deformed to an excessively great degree could not have a satisfactory adhesion of the clear coat (Comparative Example 1), and a ball that deformed to an excessively little degree could not exhibit a satisfactory shot feeling (Comparative Example 5).

In contrast, the golf balls according to the invented examples were satisfactory in all performances of the appearance, resistance to discoloring and adhesion of the clear coat after ultraviolet irradiation, and shot feeling.

Other embodiments and variations will be obvious to those skilled in the art, and this invention is not to be limited to the specific matters stated above.

What is claimed is:

1. A one-piece golf ball comprising a ball body and a clear coat, said ball body being formed from a rubber composition including a matrix rubber, an α,β-unsaturated carboxylic acid and/or its metal salt, and an organic peroxide, and said clear coat being applied onto the surface of said ball body, wherein said rubber composition is a white rubber composition containing 0.5 to 5 parts by weight of a titanium oxide, and 0.001 to 0.1 parts by weight of a blue pigment relative to 100 parts by weight of said matrix rubber, and said clear coat is a two-pack urethane comprising a polyurethane polyol and a polyisocyanate and contains 0.02 to 0.5 parts by weight of a fluorescent whitening agent, 0.05 to 3 parts by weight of an ultraviolet absorbent, and 100 parts by weight of a resinous component.

2. A one-piece golf ball according to claim 1, which deforms 2.0 to 4.0 mm by compression on condition that an initial load of 10 kgf is increased to an ultimate load of 130 kgf.

3. A one-piece golf ball according to claim 1, wherein the surface of said ball body is treated with a silane coupling agent prior to the formation of said clear coat.

4. A one-piece golf ball according to claim 1, wherein said fluorescent whitening agent includes a butyl-benzoxazole and/or derivatives thereof.

5. A one-piece gold ball according to claim 1, wherein said ultraviolet absorbent are selected from the group consisting of salicylic acid derivatives, benzophenones, benzotriazoles substituted acrylonitriles, and nickel complexes.

6. A one-piece golf ball according to claim 1, wherein the rubber composition is the white rubber composition containing 0.5 to 2.0 parts by weight of the titanium oxide, and 0.001 to 0.1 parts by weight of the blue pigment relative to 100 parts by weight of the matrix rubber.

7. A one-piece golf ball according to claim 1, wherein said clear coat is a one layer coat.

8. A one-piece golf ball according to claim 1, wherein the titanium oxide is a rutile titanium oxide.

9. A one-piece golf ball comprising a ball body and a clear coat, said ball body being formed from a rubber composition including a matrix rubber, an α,β-unsaturated carboxylic acid and/or its metal salt, and an organic peroxide, and said clear coat being applied onto the surface of said ball body, wherein said rubber composition is a white rubber composition containing 0.5 to 2 parts by weight of a rutile titanium oxide, and 0.001 to 0.1 part by weight of a blue pigment relative to 100 parts by weight of said matrix rubber, and said clear coat is a two-pack urethane comprising a polyurethane polyol and a polyisocyanate and contains 0.05 to 0.3 parts by weight of a fluorescent whitening agent, 0.5 to 2.5 parts by weight of an ultraviolet absorbent, and 100 parts by weight of a resinous component.

10. A one-piece golf ball according to claim 9, which deforms 2.0 to 4.0 mm by compression on condition that an initial load of 10 kgf is increased to an ultimate load of 130 kgf.

11. A one-piece ball according to claim 9, wherein the surface of said ball body is treated with a silane coupling agent prior to the formation of said clear coat.

12. A one-piece golf ball according to claim 9, wherein said fluorescent whitening agent includes a butylbenzoxazole and/or derivatives thereof.

13. A one-piece golf ball according to claim 9, wherein said ultraviolet absorbent is selected from the group consisting of salicylic acid derivatives, benzophenones, benzotriazoles substituted acrylonitriles, and nickel complexes.

14. A one-piece golf ball according to claim 9, wherein said clear coat is a one layer coat.

15. A one-piece golf ball comprising a ball body and a clear coat, said ball body being formed from a rubber, composition including a matrix rubber, an α,β-unsaturated carboxylic acid and/or its metal salt, and an organic peroxide, and said clear coat being applied onto the surface of said ball body, wherein said rubber composition is a white rubber composition containing 0.5 to 5 parts by weight of a titanium oxide, and 0.001 to 0.1 parts by weight of a blue pigment relative to 100 parts by weight of said matrix rubber, and said clear coat is a two-pack urethane comprising a polyurethane polyol and a polyisocyanate and essentially consists of 100 parts by weight of a resinous component 0.02 to 0.5 parts by weight of a fluorescent whitening agent, and 0.05 to 3 parts by weight of an ultraviolet absorbent.

16. A one-piece golf ball according to claim 15, which deforms 2.0 to 4.0 mm by compression on condition that an initial load of 10 kgf is increased to an ultimate load of 130 kgf.

17. A one-piece golf ball according to claim 15, wherein the surface of said ball body is treated with a silane coupling agent prior to the formation of said clear coat.

18. A one-piece golf ball according to claim 15, wherein said fluorescent whitening agent includes a butylbenzoxazole and/or derivatives thereof.

19. A one-piece golf ball according to claim 15, wherein said ultraviolet absorbent is selected from the group consisting of salicylic acid derivatives, benzophenones, benzotriazoles substituted acrylonitriles, and nickel complexes.

20. A one-piece golf ball according to claim 15, wherein the titanium oxide is a rutile titanium oxide.

21. A one-piece golf ball according to claim 15, wherein said clear coat is a one layer coat.

* * * * *